US008963899B2

(12) United States Patent
Wang et al.

(10) Patent No.: US 8,963,899 B2
(45) Date of Patent: Feb. 24, 2015

(54) DRIVER CIRCUIT FOR REDUCING IC MALFUNCTION AND LIQUID CRYSTAL DISPLAY PANEL COMPRISING SAME

(71) Applicant: Shenzhen China Star Optoelectronics Technology Co., Ltd., Shenzhen, Guangdong (CN)

(72) Inventors: Jinjie Wang, Shenzhen (CN); Cheng-hung Chen, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 184 days.

(21) Appl. No.: 13/700,488

(22) PCT Filed: Sep. 21, 2012

(86) PCT No.: PCT/CN2012/081759

§ 371 (c)(1),
(2) Date: Nov. 28, 2012

(87) PCT Pub. No.: WO2014/043893

PCT Pub. Date: Mar. 27, 2014

(65) Prior Publication Data

US 2014/0078033 A1 Mar. 20, 2014

(30) Foreign Application Priority Data

Sep. 19, 2012 (CN) ..... 2012 1 0349135

(51) Int. Cl.
*G09G 5/00* (2006.01)
*G09G 3/36* (2006.01)

(52) U.S. Cl.
CPC ..... *G09G 3/36* (2013.01)
USPC ..... 345/204; 345/211; 345/98; 349/149

(58) Field of Classification Search
CPC ..... G09G 3/36
USPC ..... 345/98–100, 204–212; 330/104, 252, 330/265, 271, 293; 349/149–152
See application file for complete search history.

(56) References Cited

U.S. PATENT DOCUMENTS

| | | | | |
|---|---|---|---|---|
| 5,216,385 | A * | 6/1993 | McDaniel | 330/282 |
| 5,831,605 | A * | 11/1998 | Yasui et al. | 345/211 |
| 2003/0234760 | A1* | 12/2003 | Lin et al. | 345/98 |
| 2004/0189563 | A1* | 9/2004 | Wu et al. | 345/87 |
| 2005/0156840 | A1* | 7/2005 | Kim et al. | 345/87 |
| 2006/0158407 | A1* | 7/2006 | Chen et al. | 345/87 |
| 2006/0232579 | A1* | 10/2006 | Chen et al. | 345/211 |
| 2013/0003246 | A1* | 1/2013 | Subramaniam | 361/160 |

* cited by examiner

*Primary Examiner* — Hong Zhou
(74) *Attorney, Agent, or Firm* — Andrew C. Cheng

(57) ABSTRACT

A driver circuit and a liquid crystal display panel for reducing IC malfunction are provided. The driver circuit includes a source driver IC, a gate driver IC, and a wire on array, wherein the source driver IC and the gate driver IC connects through the wire on array. The source driver IC provides a signal to the gate driver IC through the wire on array. The driver circuit further includes a negative feedback module electrically connected with the wire on array to be configured to keep the wire on array voltage constant. This invention also provides a liquid crystal display panel using the driver circuit. Through the above method of this invention the driver circuit and a liquid crystal display panel for reducing IC malfunction can avoid the gate driver IC to generate the malfunction caused by the voltage fluctuation of the array and improve the display quality of the liquid crystal display panel.

10 Claims, 2 Drawing Sheets

DRIVER CIRCUIT FOR REDUCING IC MALFUNCTION AND LIQUID CRYSTAL DISPLAY PANEL COMPRISING SAME

BACKGROUND OF THE INVENTION

1. Field of the Invention

The present invention relates to a display technical field, and more particularly, to a driver circuit for reducing IC malfunction and for use in a liquid crystal display panel.

2. Descriptions of the Related Art

Liquid crystal display panel includes a TFT (Thin Film Transistor) substrate, and a CF (Color Filter) substrate. An ITO (Indium Tin Oxide) transparent conductive film is set on the CF substrate. The TFT is set up a source driver IC and a gate driver IC. Between the source driver IC and the gate driver IC through a WOA (wire on array) set on the TFT substrate can transmit the signal.

However, when the liquid crystal display panel displays an image, the voltage of the ITO transparent conductive film set on the CF substrate usually changes. Changing the voltage of ITO transparent conductive film will influence to change the voltage of the WOA wire. The gate driver IC is affected by the voltage of the WOA wire. Therefore changing the voltage of the WOA wire will be easy to make the gate driver IC malfunction and make the display abnormal.

SUMMARY OF THE INVENTION

One objective of this invention is to provide a driver circuit for reducing IC malfunction and for use in a liquid crystal display panel. The driver circuit and a liquid crystal display panel for reducing IC malfunction can avoid the gate driver IC to generate the malfunction caused by the voltage fluctuation of the wire on array and improve the display quality of the liquid crystal display panel.

To solve the above technical problem, this invention is adopted the technical solution to provide a driver circuit for reducing IC malfunction and the driver circuit comprises a source driver IC, a gate driver IC, and a wire on array, wherein the source driver IC and the gate driver IC connects through the wire on array, and the source driver IC provides a driver signal to the gate driver IC through the wire on array, wherein the driver circuit further comprises a negative feedback module electrically connected with the wire on array to be configured to keep the wire on array voltage constant, wherein an input terminal of the negative feedback module electrically connects with the wire on array near to the gate driver IC, and the input terminal receives the signal of the gate driver IC from the wire on array to be configured to an input signal of the negative feedback module; an output terminal of the negative feedback module electrically connects with the wire on array near to the source driver IC to be configured to send an output signal of the negative feedback module to the wire on array; the negative feedback module includes a comparing unit, an amplifier unit, and a feedback unit electrically connected with each other.

Wherein, the comparing unit receives the input signal of the negative feedback module to be configured to compare the input signal and a feedback signal of the feedback unit to generate a differential signal and then amplify the differential signal to output to the wire on array.

Wherein, the negative feedback module includes voltage series negative feedback circuit, voltage parallel negative feedback circuit, current series negative feedback circuit, or current parallel negative feedback circuit.

To solve the above technical problem, this invention is adopted another technical solution to provide a driver circuit for reducing IC malfunction and the driver circuit comprises a source driver IC, a gate driver IC, and a wire on array, wherein the source driver IC and the gate driver IC connect through the wire on array, and the source driver IC provides a driver signal to the gate driver IC through the wire on array, wherein the driver circuit further comprises a negative feedback module electrically connected with the wire on array to be configured to keep the wire on array voltage constant.

Wherein, an input terminal of the negative feedback module electrically connects with the wire on array near to the gate driver IC, and the input terminal receives a signal of the gate driver IC from the wire on array to be configured to an input signal of the negative feedback module.

Wherein, an output terminal of the negative feedback module electrically connects with the wire on array near to the source driver IC to be configured to send an output signal of the negative feedback module to the wire on array.

Wherein, the negative feedback module includes a comparing unit, an amplifier unit, and a feedback unit electrically connected with each other.

Wherein, the comparing unit receives the input signal of the negative feedback module to be configured to compare the input signal and a feedback signal of the feedback unit to generate a differential signal and then amplify the differential signal to output to the wire on array.

Wherein, the negative feedback module includes voltage series negative feedback circuit, voltage parallel negative feedback circuit, current series negative feedback circuit, or current parallel negative feedback circuit.

To solve the above technical problem, this invention is adopted the another technical solution to provide a liquid crystal display panel comprising an array substrate and a color filter substrate, wherein the array substrate is set a driver circuit for reducing IC malfunction, and the driver circuit comprises a source driver IC, a gate driver IC, and a wire on array, wherein the source driver IC and the gate driver IC connect through the wire on array, and the source driver IC provides a driver signal to the gate driver IC through the wire on array, wherein the driver circuit further comprises a negative feedback module electrically connected with the wire on array to be configured to keep the wire on array voltage constant.

Wherein, an input terminal of the negative feedback module electrically connects with the wire on array near to the gate driver IC, and the input terminal receives the signal of the gate driver IC from the wire on array to be configured to an input signal of the negative feedback module.

Wherein, an output terminal of the negative feedback module electrically connects with the wire on array near to the source driver IC to be configured to send an output signal of the negative feedback module to the wire on array.

Wherein, the negative feedback module includes a comparing unit, an amplifier unit, and a feedback unit electrically connected each other.

Wherein, the comparing unit receives the input signal of the negative feedback module to be configured to compare the input signal and a feedback signal of the feedback unit to generate a differential signal and then amplify the differential signal to output to the wire on array.

Wherein, the negative feedback module includes voltage series negative feedback circuit, voltage parallel negative feedback circuit, current series negative feedback circuit, or current parallel negative feedback circuit.

The beneficial effect of the present invention is distinguished from the prior art technology to set a negative feedback module on the wire on array to control the voltage of the wire on array and keep the wire on array voltage constant by the negative feedback module. Therefore it can reduce the gate driver IC malfunction to be caused by the voltage fluctuation of the wire on array and improve the display quality of the liquid crystal display panel.

DESCRIPTION OF THE PREFERRED EMBODIMENT

The figures and the embodiment of the present invention will be described in detail as follows.

Figure 1:
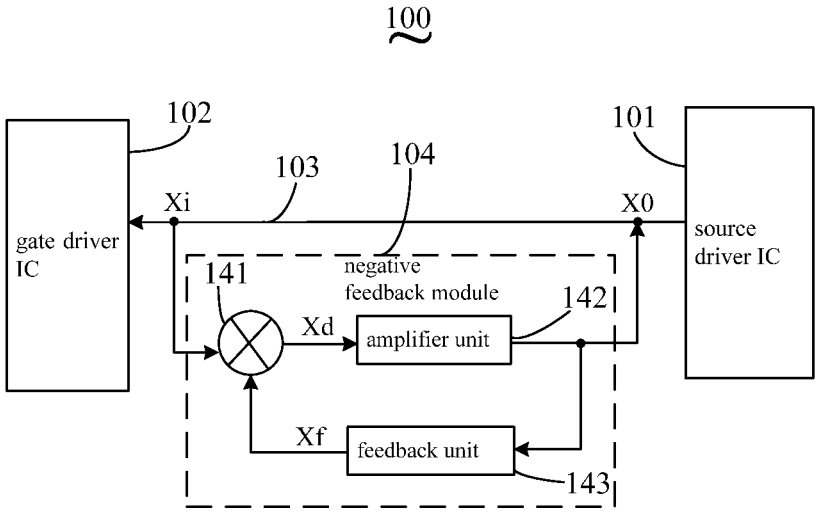
FIG. 1 is a schematic view of a driver circuit for reducing IC malfunction embodiment of the present invention.

As shown in FIG. 1, FIG. 1 is a schematic view of a driver circuit for reducing IC malfunction of embodiment in the present invention. The driver circuit 100 of this invention comprises a source driver IC 101, a gate driver IC 102, a wire on array 103, and a negative feedback module 104.

In this embodiment the source driver IC 101 and the gate driver IC 102 is connected through the wire on array 103, and the source driver IC 101 provides a driver signal to the gate driver IC 102 through the wire on array 103. The negative feedback module 104 is electrically connected with the wire on array 103. The detailed connection is as follows:

The input terminal of the negative feedback module 104 is electrically connected with the wire on array 103 near to the gate driver IC 102, and the input terminal receives the signal of the gate driver IC 102 from the wire on array 103 to be configured to an input signal Xi of the negative feedback module 104. The output terminal of the negative feedback module 104 is electrically connected with the wire on array 103 near to the source driver IC 101 to be configured to send an output signal X0 of the negative feedback module to the wire on array 103. Therefore through the negative feedback module 104 to control the voltage of the wire on array 103 is to keep the wire on array 103 voltage constant.

In this embodiment the negative feedback module 104 includes a comparing unit 141, an amplifier unit 142, and a feedback unit 143 electrically connected with each other.

Wherein, the comparing unit 141 receives the input signal Xi of the negative feedback module 104 from the wire on array 103 near to the gate driver IC 102 to be configured to compare the input signal Xi and a feedback signal Xf of the feedback unit 143 in order to generate a differential signal Xd. The amplifier unit 142 receives the differential signal Xd and then is amplified the differential signal Xd to form the output signal X0 to output it to the wire on array 103 near the source driver IC 101. The feedback signal Xf provided by the feedback unit 143 is received from the output signal X0.

Figure 2:
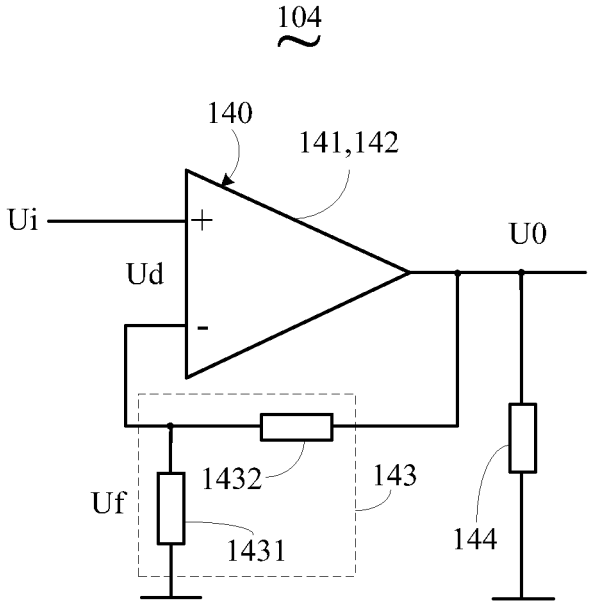
FIG. 2 is a circuit diagram of a specific embodiment of the negative feedback module shown in FIG. 1.

FIG. 2 depicts in FIG. 1 the negative feedback module is as a specific embodiment of the circuit diagram. In this embodiment the negative feedback module 104 is the voltage series negative feedback circuit. The negative feedback module 104 comprises the integrated operational amplifier 140, the feedback unit 143, and the output resistance 144.

The integrated operational amplifier 140 comprises the comparing unit 141 and the amplifier unit 142 as shown in FIG. 1. The positive input terminal of the integrated operational amplifier 140 is electrically connected with the wire on array 103 near to the gate driver IC 102. The negative input terminal of the integrated operational amplifier 140 comprises is electrically connected with the feedback unit 143. The feedback unit 143 comprises the resistance 1431 and the resistance 1432. One terminal of the resistance 1431 and one terminal of the resistance 1432 are electrically connected with the negative input terminal of the integrated operational amplifier 140. The other terminal of the resistance 1431 is grounding. The other terminal of the resistance 1432 is electrically connected with the output terminal of the integrated operational amplifier 140. The output terminal of the integrated operational amplifier 140 is further electrically connected with the wire on array 103 near to the source driver IC 101 and electrically connected with the output resistance 144. The output resistance 144 is configured to form the output voltage signal U0.

In this embodiment the integrated operational amplifier 140 receives the input voltage signal Ui of the negative feedback module 104 from the wire on array 103 near to the gate driver IC 102. The resistance 1431 and the resistance 1432 of the feedback unit 143 receives a part of the output voltage signal U0 of the integrated operational amplifier 140 to as the feedback voltage signal Uf and compare the input voltage signal 11*i* and the feedback voltage signal Uf in the integrated operational amplifier 140 to generate the differential voltage signal Ud. The integrated operational amplifier 140 amplifies the differential voltage signal Ud and then output it to get the output voltage U0. The output voltage U0 controls the voltage of the wire on array 103 near to the source driver IC 101 and keep the wire on array 103 voltage. It assures the source driver IC 101 to provide the normal driver signal to the gate driver IC 102 and reduces the malfunction of the gate driver IC 102.

In the other embodiment the negative feedback module 104 can be voltage parallel negative feedback circuit, current series negative feedback circuit, or current parallel negative feedback circuit.

Figure 3:
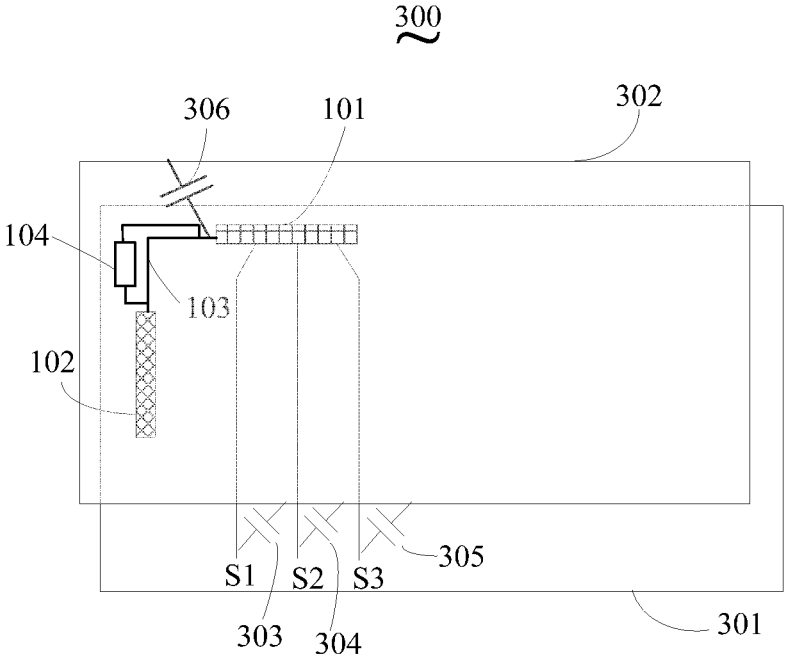
FIG. 3 is a schematic view showing a liquid crystal display panel according to an embodiment of the present invention.

FIG. 3 is schematic views of the liquid crystal display panel comprising the reduce IC malfunction driver circuit with the embodiment of this invention. As the FIG. 3 shown, the liquid crystal display panel 300 of this invention comprises an array substrate 301 and a color filter substrate 302 opposite disposed.

In this embodiment the color filter substrate 302 set a whole piece ITO transparent conductive film, wherein the ITO transparent conductive film has the same area with the array substrate 301. The array substrate 301 thereon is set the driver circuit for reducing IC malfunction as shown in FIG. 1. The driver circuit comprises a source driver IC 101, a gate driver IC 102, a wire on array 103, and a negative feedback module 104.

The source driver IC 101 and the gate driver IC 102 is connected through the wire on array 103, and the source driver IC 101 provided a driver signal to the gate driver IC 102 through the wire on array 103. In this embodiment source driver IC 101 further comprises the multiple source lines S1, S2 and S3. Between the source lines S1, S2 and S3 and the ITO transparent conductive film of the color filter substrate 302 it form the capacitor structures 303, 304 and 305. Similarly between the ITO transparent conductive film of the color filter substrate 302 and the wire on array 103 it forms the capacitor structures 306.

In this embodiment the negative feedback module 104 is same with the negative feedback module of the driver circuit for reducing IC malfunction shown in FIG. 1 and the detail structure will not be described herein.

As shown in FIGS. 1 to 3, the manufacturing process of the liquid crystal display panel 300 is as the following. When the liquid crystal display panel 300 displays the image, the source lines S1, S2 and S3 in the array substrate 301 send the signals simultaneous. By transmitting the signals of the source lines S1, S2 and S3, the voltage of the ITO transparent conductive film on the color filter substrate 302 is changed easily. Changing the voltage of ITO transparent conductive film is to be configured to alter the voltage of the wire on array 103.

The comparing unit 141 receives the unstable voltage signal from the wire on array 103 near to the gate driver IC 102 to be the input voltage signal of the negative feedback module 104 and then is configured to compare the input voltage signal and the feedback signal of the feedback unit 143 in order to generate a differential voltage signal. The amplifier unit 142 receives the differential voltage signal and then is amplified the differential voltage signal to form the output voltage signal and output it to the wire on array 103 near the source driver IC 101 to be configured to control the voltage of the wire on array 103. The feedback voltage signal provides by the feedback unit 143 is received from the output voltage signal.

This invention embodiment is to use the negative feedback module 104 to control the voltage of the wire on array 103 and keep the voltage of wire on array 103 constant. It can reduce the gate driver IC 102 malfunction and improve the display quality of the liquid crystal display panel 300.

In conclusion, the invention is set up a negative feedback module electrically connected with the wire on array to receive the voltage signal of the wire on array near to the gate driver IC and then compare and adjust the feedback voltage signal received from negative feedback module. Finally output it to the wire on array near the source driver IC to be configured to control the voltage of the wire on array and keep the voltage of the wire on array constant. Therefore it can reduce the gate driver IC malfunction to be caused by the voltage fluctuation of the wire on array and improve the display quality of the liquid crystal display panel.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A driver circuit for reducing IC malfunction, the driver circuit comprising:

a source driver IC, a gate driver IC, and a wire on array, wherein the source driver IC and the gate driver IC connect through the wire on array and the source driver IC provides a driver signal to the gate driver IC through the wire on array;

the driver circuit further comprising a negative feedback module electrically connected with the wire on array to be configured to keep the wire on array voltage constant;

wherein an input terminal of the negative feedback module electrically connects with the wire on array near to the gate driver IC, and the input terminal receives a signal of the gate driver IC from the wire on array to be configured to an input signal of the negative feedback module;

an output terminal of the negative feedback module electrically connected with the wire on array near to the source driver IC to be configured to send an output signal of the negative feedback module to the wire on array;

the negative feedback module including a comparing unit, an amplifier unit, and a feedback unit electrically connected with each other;

wherein the comparing unit receives the input signal of the negative feedback module to be configured to compare the input signal and a feedback signal of the feedback unit to generate a differential signal and then amplifier unit amplifies the differential signal to output to the wire on array.

2. The driver circuit as claimed in claim 1, wherein the negative feedback module includes voltage series negative feedback circuit, voltage parallel negative feedback circuit, current series negative feedback circuit, or current parallel negative feedback circuit.

3. A driver circuit for reducing IC malfunction, the driver circuit comprising: a source driver IC, a gate driver IC, and an wire on array, wherein the source driver IC and the gate driver IC connect through the wire on array, the source driver IC provides a driver signal to the gate driver IC through the wire on array, wherein the driver circuit further comprises a negative feedback module electrically connected with the wire on array to be configured to keep the wire on array voltage constant; wherein the negative feedback module includes a comparing unit, an amplifier unit, and a feedback unit electrically connected each other; and wherein the comparing unit from the wire on array near to the gate driver IC receives an input signal of the negative feedback module to be configured to compare the input signal and a feedback signal of the feedback unit to generate a differential signal and then the amplifier unit amplifies the differential signal to output to the wire on array near to the source driver IC.

4. The driver circuit as claimed in claim 3, wherein an input terminal of the negative feedback module electrically connects with the wire on array near to the gate driver IC, and the input terminal receives the signal of the gate driver IC from the wire on array to be configured to the input signal of the negative feedback module.

5. The driver circuit as claimed in claim 4, wherein an output terminal of the negative feedback module electrically connects with the wire on array near to the source driver IC to be configured to send an output signal of the negative feedback module to the wire on array.

6. The driver circuit as claimed in claim 3, wherein the negative feedback module includes voltage series negative feedback circuit, voltage parallel negative feedback circuit, current series negative feedback circuit, or current parallel negative feedback circuit.

7. A liquid crystal display panel comprising an array substrate and a color filter substrate, wherein a driver circuit for reducing IC malfunction is set on the array substrate, and the driver circuit comprises a source driver IC, a gate driver IC, and a wire on array, wherein the source driver IC and the gate driver IC connect through the wire on array and the source driver IC provides a driver signal to the gate driver IC through the wire on array;

the driver circuit further comprising a negative feedback module electrically connected with the wire on array to be configured to keep the wire on array voltage constant;

wherein the negative feedback module includes a comparing unit, an amplifier unit, and a feedback unit electrically connected each other;

wherein the comparing unit from the wire on array near to the ate driver IC receives an input signal of the negative feedback module to be configured to compare the input signal and a feedback signal of the feedback unit to generate a differential signal and then the amplifier unit amplifies the differential signal to output to the wire on array near to the source driver IC.

8. The liquid crystal display panel as claimed in claim 7, wherein an input terminal of the negative feedback module electrically connects with the wire on array near to the gate driver IC, and the input terminal receives the signal of the gate driver IC from the wire on array to be configured to the input signal of the negative feedback module.

9. The liquid crystal display panel as claimed in claim 8, wherein an output terminal of the negative feedback module electrically connects with the wire on array near to the source driver IC to be configured to send an output signal of the negative feedback module to the wire on array.

10. The liquid crystal display panel as claimed in claim 7, wherein the negative feedback module includes voltage series negative feedback circuit, voltage parallel negative feedback circuit, current series negative feedback circuit, or current parallel negative feedback circuit.

* * * * *